United States Patent [19]

Charney

[11] Patent Number: 4,629,195

[45] Date of Patent: Dec. 16, 1986

[54] TRAVEL GAME ARRANGEMENT

[76] Inventor: Fred D. Charney, 575 Third St., Brooklyn, N.Y. 11215

[21] Appl. No.: 658,302

[22] Filed: Oct. 5, 1984

Related U.S. Application Data

[62] Division of Ser. No. 483,762, Apr. 11, 1983, Pat. No. 4,484,749.

[51] Int. Cl.[4] ..... A63F 3/00

[52] U.S. Cl. ..... 273/254; 273/256

[58] Field of Search ..... 273/254, 256, 278, 244, 273/247, 298, 283, 251, 252

[56] References Cited

U.S. PATENT DOCUMENTS

| | | | |
|---|---|---|---|
| 2,026,082 | 12/1935 | Darrow | 273/256 |
| 3,057,624 | 10/1962 | Bassett | 273/283 |
| 3,058,747 | 10/1962 | Nemetsky | 273/256 |
| 4,032,153 | 6/1977 | Daum | 273/256 |
| 4,040,629 | 8/1977 | Kelly | 273/278 |

FOREIGN PATENT DOCUMENTS

| | | | |
|---|---|---|---|
| 10811 | of 1913 | United Kingdom | 273/298 |
| 627951 | 8/1949 | United Kingdom | 273/247 |

*Primary Examiner*—Richard C. Pinkham
*Assistant Examiner*—Matthew L. Schneider
*Attorney, Agent, or Firm*—Kirschstein, Kirschstein, Ottinger & Israel

[57] ABSTRACT

A travel game including a gameboard having indicia thereon relating to various locales. The game further includes a plurality of stackable time pieces which indicate the game time, a plurality of business establishment coupons which are associated with business establishment zones provided on the playing surface regions and present at the respective locales of such regions, these coupons being exchangeable for monetary coupons when a respective pawn lands on the respective zone as determined by the throw of dice, and postcards which can be revealed after a business establishment coupon has been betted thereon. The game also includes one terminating member which is randomly placed in the stack of time pieces and which indicates the end of the game.

8 Claims, 9 Drawing Figures

TRAVEL GAME ARRANGEMENT

This is a division of application Ser. No. 483,762 filed Apr. 11, 1983, now U.S. Pat. No. 4,484,749.

BACKGROUND OF THE INVENTION

The present invention generally relates to games and more particularly to a game arrangement suited for playing a novel travel game.

Various games, including games of skill as well as games of chance, have been developed over the centuries. Especially games of chance have acquired a high degree of popularity, since they enable the players to engage in an activity which is relaxing and yet exciting so that the players, while concentrating on the game, take their minds off their everyday problems. With changing society, some games lose their appeal, and some remain popular. Thus, there is a limited number of games which are available at any given time to the public. Most of the currently available games can be mastered in a relatively short period of time, so that they lsoe their appeal to persons who know the "ins and outs" of such games. Therefore, there is a pronounced demand for new games which would provide new challenges to such persons. Moreover, there is a desire for games which reflect current behavioral patterns of the society. It is especially in the latter area where the supply of games is rather meager, since most of the games have been developed decades if not centuries ago and in many respects reflect the society as it existed then.

The conventional games also have other disadvantages, such as, for instance, the invariability of the playing surface, lack of variety in the tasks to be performed by the players during the game, inflexibility of the course of the game, and the like.

SUMMARY OF THE INVENTION

Accordingly, it is a general object of the present invention to avoid the disadvantages of the prior art.

More particularly, it is an object of the present invention to develop a game which does not possess the disadvantages of the conventional games.

Still another object of the present invention is to provide a game which caters to the desire of the players to travel and to amass property.

It is yet another object of the present invention to devise a gameboard for the above game which is simple in construction, inexpensive to manufacture, easy to use, and which permits to reconfigurate the playing surface in accordance with the desires of the players.

A concomitant object of the present invention is to so equip the gameboard with additional game elements as to be able to deviate from a single prescribed game plan under certain conditions in accordance with the desires of the individual players.

The present invention is directed to a game comprising a gameboard which carries a plurality of playing zones arranged in at least one continuous endless path, at least one playing piece or pawn for each player, and means, such as a die or dice, for determining the number of the playing zones by which the playing pieces advance during a turn of the game. Then, it is advantageous when, in accordance with one facet of the present invention, at least one of the playing zones, but advantageously as many of the playing zones as there are gameboard elements or different playing surfaces, is a time zone, and when there is provided a plurality of time-indicating members which are consecutively arranged in a stack during the game and which are individually revealed on advancement of one of the playing pieces to the time zone, such as when the respective playing piece lands on the time zone. Then, there may be further provided a terminating member which is insertable into any position in the stack to indicate the end of the game. The use of the terminating member renders it possible to predetermine the duration of the game. The time-indicating members indicate game time which is unrelated to the real time since the advancement of the game time occurs in dependence on the advancement of the respective playing piece to the time zone and especially landing thereon. Nevertheless, the probability that the game will be shorter when the terminating piece is situated closer to the top of the stack is increased.

According to a currently preferred concept of the present invention, the playing surface of the gameboard is subdivided into a plurality of playing surface regions each of which is associated with a different locale. Then, the playing zones situated in the respective playing surface regions, or at least most of them, are associated with different business establishments which can in reality be found at such locales. One of these business establishments advantageously is a travel agency. Then, the game further includes a plurality of coupons which are distributable to the players during the game, and a plurality of postcards respectively associated with the locales and arranged during the game in a stack in such a manner that the locales are concealed. Then, the player may risk one of the coupons owned by him or her against at least one coupon owned by a bank and then reveal the postcard. When the locale of the postcard is the same as the locale of the travel agency on which the playing piece has landed at the time of risking the coupons, the player gets the risked coupon from the bank and retains his or her own coupon; if there is disagreement, the player loses the risked coupon. Advantageously, the coupons include business establishment coupons which are at risk on the part of the players and monetary coupons which are transferred to the players from the bank when the players win this betting feature of the game.

According to still another facet of the present invention, the business esatblishment coupons are exchangeable against the monetary coupons when the respective playing piece lands on the business establishment playing zone to which the respective player owns the business establishment coupon. Advantageously, the business establishment coupons come in sets, such as in sets of three coupons for each of the business establishments. Then, an increasing bonus is payable to the respective player whose playing piece lands on the respective business establishment playing zone on exchange of an increasing number of the business establishment coupons of the respective set for the monetary coupons at the same time.

The business establishment coupons can be obtained in various ways. So, for instance, when a playing piece lands on a playing zone already occupied by a playing piece of another player, the subsequently arriving player is entitled to take a business establishment coupon from the previously arriving player. However, there is also a chamber of commerce playing zone in each locale, and the respective player receives a complementary coupon when his or her playing piece lands on the chamber of commerce playing zone. Another possibility of business establishment coupon acquisition is by purchasing the same at a predetermined price when the respective playing piece lands on a playing zone denoted as newsstand in the respective locale.

Advantageously, the aforementioned time-indicating members, in addition to indicating game time, also display information as to other attributes of the game. Such other attribute may be, for instancce, the purchase price of a coupon at the given time. Another such attribute may be a limousine fare from a hotel playing zone to any desired business establishment, and/or a tax to be paid at the particular game time when the playing piece lands on a bureau of taxation playing zone.

Finally, it is also advantageous when, in accordance with a further feature of the present invention, the path has at least two parallel branches through each of the locales. This enables the player to choose the route to be taken by the playing piece through the respective locale, so as to increase the probability of landing on desirable, or avoiding landing on undesirable, playing zones.

The novel features which are considered as characteristic of the invention are set forth in particular in the appended claims. The novel game arrangement itself, however, both as to its construction and its mode of use during the progress of the game, together with additional features and advantages thereof, will be best understood upon perusal of the following detailed description of certain specific embodiments with reference to the accompanying drawing.

DETAILED DESCRIPTION OF THE PREFERRED EMBODIMENTS

Figure 1:
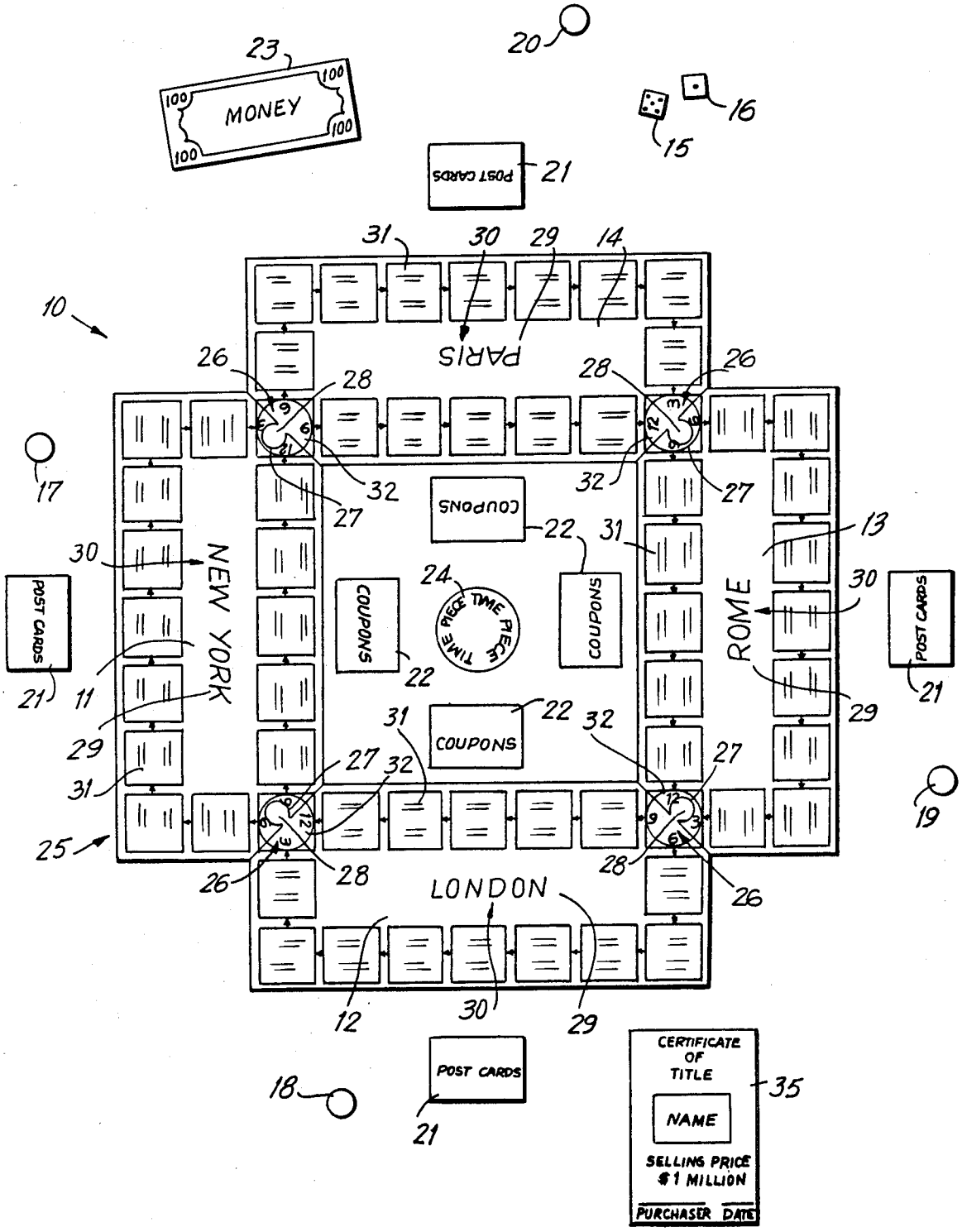
FIG. 1 is a top plan view of a travel game arrangement of the present invention in its assembled condition for playing a travel game, with some details omitted for clarity.

Referring now to the drawing in detail, and first to FIG. 1 thereof, it may be seen that the reference numeral 10 has been used therein to identify a game arrangement of the present invention in its entirety. As shown, the game arrangement 10 includes four gameboard elements 11, 12, 13 and 14, a pair of dice 15 and 16, four pawns or similar playing pieces 17, 18, 19 and 20 which are visually distinguished from one another, from instance, by having different colors, a plurality of postcards 12 which may be arranged in four different stacks, each situated, for instance, outside the space occupied and bounded by the gameboard elements 11, 12, 13, and 14 during the game, next to the respective gameboard element 11, 12, 13, or 14, a plurality of business establishment coupons 22 that may again be arranged at the outset of the game in four different stacks, but this time with the stacks arranged next to the respective gameboard element 11, 12, 13, or 14 within the space bounded by the gameboard elements 11, 12, 13 and 14 during the game, and a plurality of monetary coupons or play money bills 23, as well as a plurality of time-indicating members or time pieces 24 which may again be arranged in a stack in the space bounded by the gameboard elements 11, 12, 13 and 14. The gameboard elements 11, 12, 13 and 14 are separate from one another so that they can be stacked for storage purposes. However, prior to the beginning of the game, the gameboard elements 11, 12, 13 and 14 are assembled with one another in the manner depicted in FIG. 1, so as to form a gameboard 25.

To hold the gameboard 25 together with the gameboard elements 11, 12, 13 and 14 in the illustrated positions, interconnecting means 26 are provided at the portions of the gameboard elements 11, 12, 13 and 14 which are situated adjacent one another in the assembled condition of the gameboard 25. The interconnecting means include respective female formations or cutouts 27 and male formations or projections 28 which are received in the respective cutouts 27 in the assembled condition of the gameboard 25. Advantageously, the formations 27 and 28 have compatible or complementary configurations, for instance, the partly circular configurations depicted in FIG. 1, so that, upon assembly, they form a substantially uninterrupted playing zone with one another. It may also be seen that, for reasons which will be discussed later, two, or one half, of the gameboard elements 11 to 14, that is, the elements 11 and 13, have only the female formations 27, while the other half of the gameboard elements 11 to 14, that is, the gameboard elements 12 and 14, only have the male formations 28. This, of course, presupposes that the number of the gameboard elements 11 to 14 is even, as it is in the situation illustrated in FIG. 1. Should it be desired to have a gameboard with an odd number of gameboard elements, then one of such elements would be provided with one male and one female formation, while the others would still have only male or only female formations, in respective pairs.

The gameboard elements 11 to 14 are shown in FIG. 1 to have polygonal, and more specifically rectangular configurations. Each of the gameboard elements 11 to 14 has one major or playing surface 29 which carries an inscription identifying a different locale, such as a city a borough, a city section, a city street or the like. This inscription is identified by a reference numeral 30. The playing surface 29 also carries a plurality of business establishment zones 31 which are arranged in a continuous endless path through all the locales in the assembled condition of the gameboard 25. As mentioned before, the male and female formations 27 and 28 form a continuous playing surface zone. This zone, which will be referred-to herein as a time zone, is identified by the reference numeral 32.

Figure 2B:
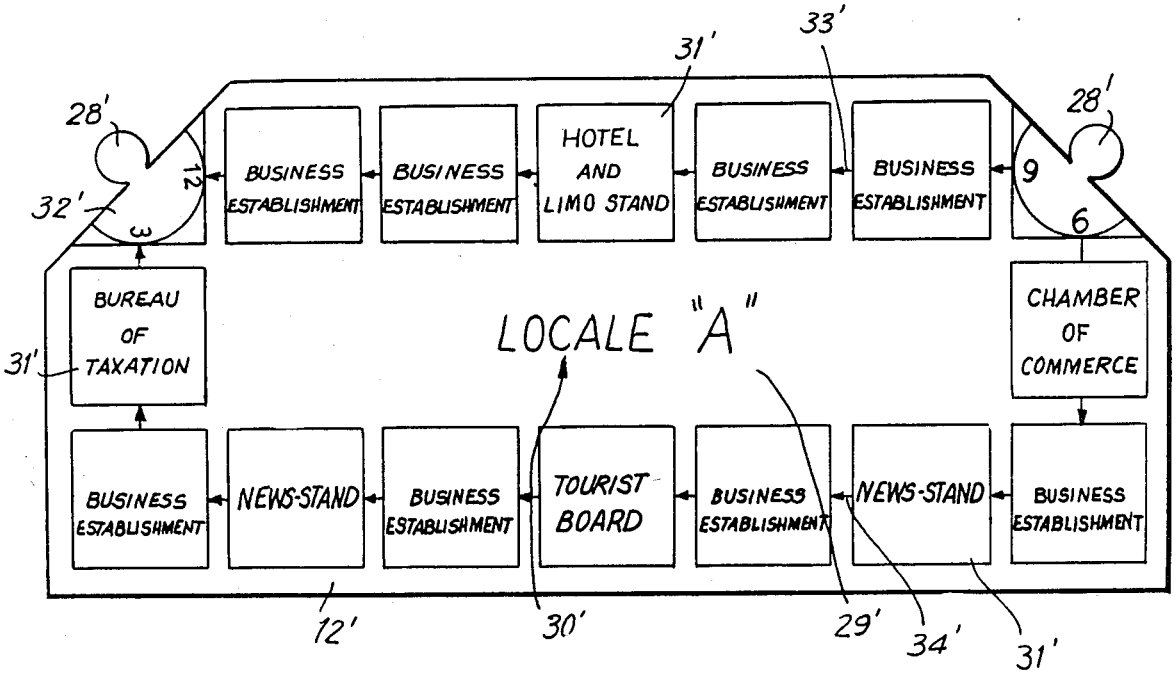
FIG. 2B is a plan view of a generic gameboard element, and denotes in general terms the various playing zones which are provided on both the obverse and reverse sides of any gameboard element, it being understood that both sides of each actual gameboard element are provided with popular names of business establishments and hotels of the respective locale as shown in FIG. 2A.
Figure 2A:
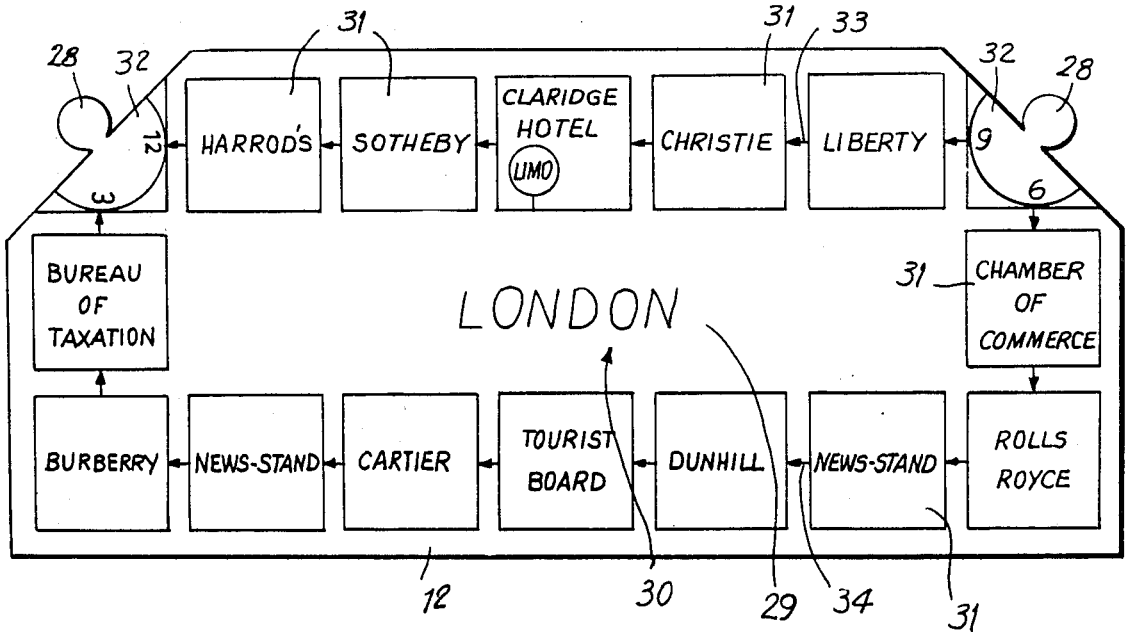
FIG. 2A is a top plan view of a representative one of the four elements which together constitute the gameboard shown in FIG. 1 at a reduced scale.

As may be seen in FIGS. 2A and 2B on the example of the gameboard element 12, each of the gameboard elements 11 to 14, in addition to the major or playing surface 29 on its one or obverse side, also has another major or playing surface 29' on its other or reverse side which exhibits the same features as the playing surface 29 discussed above, except for a different locale. However, to distinguish the features of the playing surface 29 from those of the playing surface 29', they have been identified by the corresponding reference numerals, but supplemented with a prime. In FIG. 2B a generic description has been used for the locale and the zones 31' associated with that locale. It will be understood that the gameboard elements are not provided with an actual generic element as shown in FIG. 2B, but that the generic description is merely for purposes of illustration. Thus, if one side of representative element 12 of FIG. 2A shows the locale to be London so that the zones 31 bear identifications of business and hotel establishments which can in reality be found in London, then the opposite side 12' of element 12 will be provided with a different locale, e.g. Tokyo, and with zones 31' bearing identification of business and hotel establishments which can in reality be found in Tokyo. Of course, any other locale could have been chosen, and this is the reason for illustrating the opposite side of representative element 12 with a generic description. It may also be seen in FIGS. 2A and 2B that the zones 31 or 31' are arranged in two parallel branches 33 or 33' and 34 and 34' which lead from one of the time zones 32 or 32' to the other, which enables the player to choose which route to follow through the respective locale so as to increase the probability of landing on desirable zones 31 or 31' and decrease the probability of landing on undesirable zones 31 or 31'. Certainly, the zone 31 or 31' which is identified as a Bureau Of Taxation is an undesirable location, since the player must pay the tax due when his or her playing piece 17, 18, 19, or 20 lands on this particular zone 31 or 31', but it is arranged in the same branch 34 or 34' as other zones 31 or 31' at least some of which may be desirable to the player in accordance with the rules and progress of the game.

A desirable location may be, for instance, the respective zone 31 or 31' which is identified as a hotel, since a limousine stand is situated thereat and, upon payment of the limo fare, the player can move his or her pawn 17, 18, 19, or 20 to any other business establishment zone 31 or 31' within the particular locale, or to one or the other of the time zones 32 or 32' associated with this locale. Another desired location is the zone 31 or 31' identified as a newsstand, since the player may purchase, for a predetermined amount of money, one of the business establishment coupons 22 from the stack associated with the respective locale. Yet, the probably most desirable location is the zone 31 or 31' which is identified as the Chamber of Commerce, since the player receives a complimentary coupon 22 for the respective locale at this zone 31 or 31'. Moreover, it is advantageous for a player to land on a zone 31 or 31' already occupied by at least one playing piece 17, 18, 19 or 20, since the player whose playing piece 17, 18, 19, or 20 already present at such a zone 31 or 31' must relinquish one of his or her coupons 22 to the newcomer.

The purpose of the game is to amass a fortune in the monetary coupons 23, so as to be able to purchase a property at any of the locales following the end of the game, provided that the player has a sufficient amount in play money coupons 23 to pay the selling price of the property. Usually, only the player with the highest amount in the play money coupons is permitted to purchase the property. A shown in FIG. 1, the game arrangement 10 may further comprise a certificate of title 35 which lists the selling price of the respective property and which can be filled-out with the name of the purchaser and the date of the purchase, so that the player can take this certificate 35 home as evidence of winning the game and spending the monetary coupons 23 for purchasing a property. A replenishable supply of such certificates 35 may be provided to be able to sell the same to the respective winners of the individual games.

Except for a small amount of "seed money" distributed to the players at the beginning of the game in the form of the monetary coupons 23, the monetary coupons 23 are accumulated by the players by exchanging the business establishment coupons 22 owned by the players for predetermined amounts of the monetary coupons 23 when their playing pieces 17, 18, 19 or 20 land on the business establishment zones 31 or 31'. For each business establishment zone 31 or 31' which has business establishments coupons 22 associated therewith (and, for instance, the zones 31 or 31' identified as Chamber of Commerce and Bureau of Taxation need not and preferably do not), there may advantageously be provided a set, for instance of three, of the business establishment coupons 22. then, an extra bonus on top of the exchange price of the individual business establishment coupons 22 may be payable on exchange of two, and an even higher bonus on exchange of all three, of the business establishment coupons 22. The coupons 22 are placed in front of their owners face or the obverse side up, so that all of the players can see which business esablishment coupons 22 are owned by the respective players. This enables the players to select on capture those of the coupons 22 of the respective opponents which best fit into their respective portfolios or which will most disrupt the portfolios of their opponents.

Figure 3A:
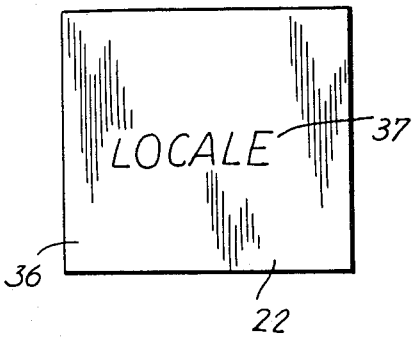
FIGS. 3A and 3B are views of the obverse and reverse sides of a business establishment coupon.
Figure 3B:
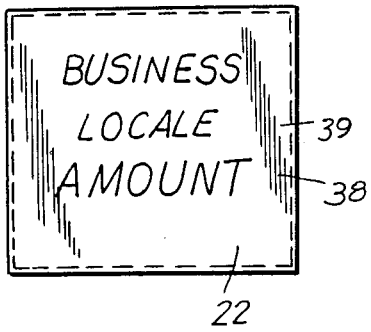

One of the business establishment coupons 22 is shown, in generic representation, in FIGS. 3A and 3B. The reference numeral 36 identifies the reverse side or back of the coupon 22, which carries an indication 37 of the locale, but no indication of the business establishment. This indication 37 may be used for sorting the coupons 22 into the respective stacks associated with the locales. The reverse sides 36 face up and are thus visible when the coupons 22 are arranged in the respective stacks. The obverse side or front of the business establishment coupon 22 is denoted by the reference numeral 38. This obverse side 38 carries indicia 39 of the business establishment, the locale, and the monetary amount, exclusive of the aforementioned bonus, payable to the player on exchange or redemption of the coupon at the associated business establishment zone 31 or 31'.

Figure 4A:
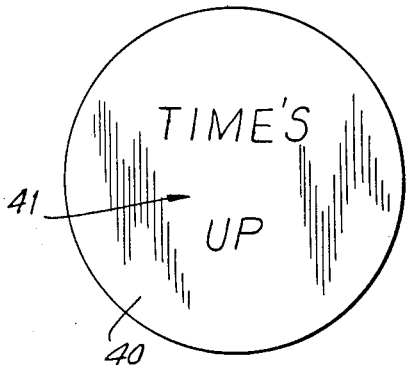
FIGS. 4A and 4B are views of the obverse sides respectively of a terminating member and a time-indicating member.

FIG. 4A shows a circular terminating member 40 that can be inserted at any location of the stack of the time pieces or time-indicating members 24. This terminating member bears the legend "Time's up" or words or symbols of similar import indicating the end of the game. However, instead of providing a separate terminating member 40, the legend 41 may be provided on the reverse side or back of any of the time-indicating members 24, in which case the time-indicating members 24 are arranged in the stack face up except for the time-indicating member 24 which is to serve as the terminating member 40 which is placed at the desired location in the stack with its back facing upwardly. In each instance, the same effect, that is, the termination of the game before or upon the exhaustion of the stack of the time-indicating members 24, will be achieved. During the game, the time-indicating members 24 are revealed in succession whenever a particular playing piece 17, 18, 19 or 20 lands on any of the time zones 32 or 32'. Thus, the game progresses toward its conclusion in dependence on the number of such landings, and the place of the terminating member 40 in the stack.

Figure 4B:
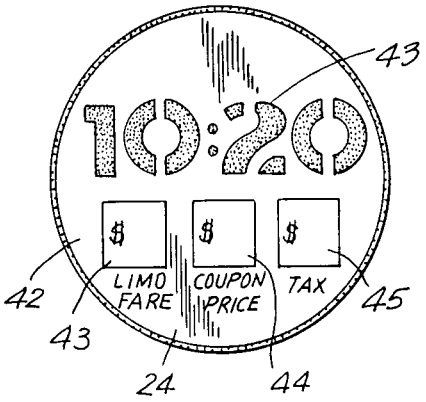

As shown in FIG. 4B, the time-indicating member 24 has an obverse side or front 42 which bears an indication 43 of the "game time" which is unrelated to real time. Furthermore, the front 42 of the time piece 24 has three different indicia 43, 44, and 45 which indicate, respectively, the limo fare, the business establishment coupon purchasing price, and the tax payable, at the particular time 43, these rates and prices changing as the time progresses.

Figure 5A:
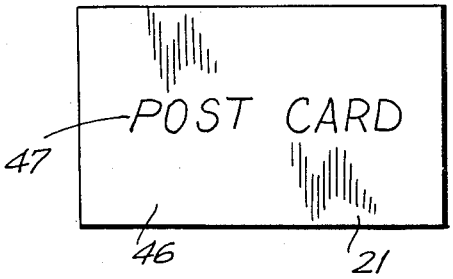
FIGS. 5A and 5B are views of the obverse and reverse side of a postcard.
Figure 5B:
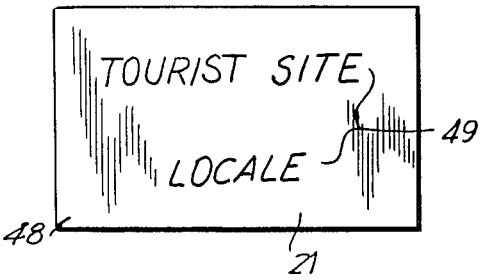

FIGS. 5A and 5B depict one of the postcards 21, in rear and front views, respectively. The postcard 21 has a reverse side or back 46 which is provided with an inscription or other indentification of its character as a postcard, but no indication of the locale with which it is associated. The inscription is indentified by the reference numeral 47. On the other hand, an obverse side or face 48 of the postcard 21 has an image, description, or other indentification 49, of a tourist attraction or a similar site of interest situated at the particular locale, possibly with an indentification of the locale itself. Since the reverse side 46 does not reveal the identity of the locale, the postcards 21 can be used for adding to the excitement of the game by introducing an element of risk. To this end, the postcards 21 are randomly distributed among the stacks and are arranged in the respective stacks with their faces 48 down. When the pawn 17, 18, 19 or 20 of the respective player lands on the respective business establishment zone 31 or 31' denoted as the tourist board, he or she has a choice of betting or risking one of his or her business establishment coupons 22 against a predetermined sum payable by the bank in the monetary coupons 23, provided, of course, that the player owns at least one coupon 22. Then, the top postcard 21 from the respective stack is flipped over and, if it reveals that the tourist attraction indicated on the face 48 is situated at the locale of the tourist board, the player collects the money; otherwise, the coupon 22 at risk is lost and is returned to the bottom of the respective stack associated with its locale.

As may be seen in FIG. 1, the playing surface regions 30 of the gameboard elements 11, 12, 13, and 14, face up in the configuration of the gameboard 25 shown therein. This is rendered possible by the provision of only the male formations 28 on the gameboard elements 12 and 14, and of only the female formations 27 on the gameboard elements 11 and 13. Hence, the orientation of each of the elements 11, 12, 13, or 14 in the gameboard 25 can be reversed in such a manner that either the playing surface region 30, or the playing surface region 30', faces upwardly, and yet the interengaging means 26 will be capable of fittingly or compatibly interengaging. This would not be achieved if the respective elements 11, 12, 13 and 14 were provided with both types of the formations 27 and 28, one at each of their ends, in a gameboard assembly having an even number of the gameboard elements. Because of this reversibility of the orientation of the gameboard elements 11, 12, 13 and 14, there can be chosen a multitude of different combinations of the locales which are to appear in the particular configuration of the gameboard 25 during the respective game.

The game may be provided with more than four gameboard elements, i.e. eight different locales. Additional gameboard elements for still other locales, as well as appropriate coupons and postcards, can be offered, thus permitting for an on-going ever-increasing variety of locales without the game players being required to acquire equipment already in their possession. Trading of different gameboard elements between game players is also possible. The expanded number of different gameboard configurations adds to the play value. More than four pawns, or pawns configurated in shapes descriptive of the various locales, may be provided to increase the overall play value. The locales and/or business and hotel establishments employed in the game may be real or fictional.

Another feature of my invention is that the gameboard may change during play. Specifically, if a gameboard element is vacant, i.e. has no playing pieces located theron, and the player whose turn it is rolls a double, i.e. the count on each die is the same, then this player may, at his option, reverse the orientation of the vacant gameboard element before he moves his playing piece and, concomitantly, the coupon stack is exchanged for the new locale. This strategic option is employed in order to frustrate the other players from redeeming coupons on the locale which is now face down and, hence, not in play.

During succeeding turns, the reversed gameboard element, if vacant again and is a player rolls a double, may again be turned to its previous orientation and, concomitantly, the previous coupon stack returned, in order to permit the previously frustrated players to redeem their coupons. Thus, any gameboard element may be changed one or more times during play, and this feature provides the overall game with still more entertainment reward.

It will be understood that each of the elements described above, or two or more together, may also find a useful application in other types of game arrangements differing from the type described above.

While the invention has been illustrated and described as embodied in a travel game, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A game comprising a gameboard carrying a plurality of playing zones arranged at least in one continuous endless path, at least one of said playing zones being a time zone; at least one playing piece for each player of the game; means for determining the number of said playing zones by which said playing pieces advance during a turn of the game; a plurality of time-indicating members bearing game-time indications that are numerically and consecutively arranged in a stack and individually revealed on advancement of one of said playing pieces to and landing on said time zone, said game-time indications denoting the progress of the game toward its conclusion in dependence upon the number of such landings; and a terminating member insertable into any position in said stack of time-indicating members to indicate the end of the game.

2. The game as defined in claim 1, wherein each of said time-indicating members, besides the game time information, also carries additional information as to various other attributes of the game that varies in accord with game time.

3. The travel game as defined in claim 1, wherein the gameboard is assembled from a plurality of separate gameboard elements each carrying on a major surface thereof a playing surface region solely associated with a different locale, said one continuous endless path extending through all of said locales of said assembled gameboard elements, said playing zones on each gameboard element being associated with business establishments solely located at the respective locales; and a plurality of coupons including business establishment coupons distributable to the players during the game and associated with the various business establishments of the respective locales, and monetary coupons held by a bank and distributable to the players, each of said business establishment coupons being exchangeable for a predetermined value of said monetary coupons when the playing piece of the player owning such business establishment coupon lands on the playing zone associated with the same business establishment.

4. The travel game as defined in claim 3, wherein said business establishment coupons come in respective sets, each set being associated with a different one of said business establishments; and wherein an increasing bonus is payable to the respective player on exchange of an increasing number of said business establishment coupons of the respective set for said monetary coupons.

5. The travel game as defined in claim 3, wherein at least one of said playing zones is a complimentary zone; and wherein the player whose playing piece lands on such complimentary playing zone is awarded a complimentary business establishment coupon.

6. The travel game as defined in claim 3, wherein at least one of said playing zones is associated with a newsstand; and wherein a player whose playing piece lands on such newsstand playing zone is entitled to purchase a business establishment coupon for a predetermined number of said monetary coupons.

7. The travel game as defined in claim 3, wherein said path has at least two parallel branches through each of said locales, each including different business establishment playing zones, for the player to choose the desired route of the respective playing piece through the respective locale.

8. A travel game comprising a gameboard having a plurality of playing surface regions each associated with a different locale and having a multitude of playing zones arranged in at least one continuous endless path through all of said locales, said playing zones being associated with business establishments at the respective locales, at least one of which is associated with a tourist agency and others of which are associated with tourist attractions; at least one playing piece for each player of the game; means for determining the number of said playing zones by which said playing pieces advance during a turn of a game; a plurality of business establishment coupons and monetary coupons distributable to the players during the game; and a plurality of postcards each having one side bearing an indication of a tourist attraction associated with a respective locale, and an opposite side in which said indication is concealed, said postcards being arranged in stacks with said one sides facing away from the players during the game in such a manner that said indications are concealed, said postcards and said tourist agency zones being related such that each postcard is removed from the respective stack and overturned to reveal the locale of said indication on said respective one side when the respective playing piece lands on the tourist agency playing zone for risking one of said business establishment coupons owned by the respective player against at least one monetary coupon owned by a bank for transfer of said one monetary coupon to the player when the locale of said tourist attraction on said overturned postcard corresponds to the locale of the tourist agency playing zone that was landed on, and for transfer of said business establishment coupon to the bank when the locale of said tourist attraction on said overturned postcard does not correspond to the locale of the tourist agency playing zone that was landed on.

* * * * *